US009700134B1

(12) United States Patent
Simpson, II et al.

(10) Patent No.: US 9,700,134 B1
(45) Date of Patent: Jul. 11, 2017

(54) FOLD DOWN TABLE FOR BATHROOM

(71) Applicant: Zavie, Limited Liability Company, Pompano Beach, FL (US)

(72) Inventors: Darryl Xavier Simpson, II, Pompano, FL (US); Darryl Gerard Simpson, Pompano, FL (US)

(73) Assignee: Zavie, Limited Liability Company, Pompano Beach, FL (US)

( * ) Notice: Subject to any disclaimer, the term of this patent is extended or adjusted under 35 U.S.C. 154(b) by 0 days.

(21) Appl. No.: 15/070,301

(22) Filed: Mar. 15, 2016

(51) Int. Cl.

| | |
|---|---|
| ***A47B 5/04*** | (2006.01) |
| ***A47B 13/00*** | (2006.01) |
| ***A47B 96/02*** | (2006.01) |
| *A47K 17/00* | (2006.01) |

(52) U.S. Cl.
CPC ..... *A47B 5/04* (2013.01); *A47B 13/00* (2013.01); *A47B 96/025* (2013.01); *A47B 96/028* (2013.01); *A47K 17/00* (2013.01)

(58) Field of Classification Search
CPC ..... E04H 1/1266; A47D 5/006; A47B 5/04; A47B 13/00; A47B 13/081; A47B 96/028; A47B 96/025; E05C 17/56
USPC ..... 52/36.5; 292/251.5
See application file for complete search history.

(56) References Cited

U.S. PATENT DOCUMENTS 2,521,885 A * 9/1950 Vasquez ..... E05C 19/16 211/DIG. 1
2,792,053 A * 5/1957 Kursman ..... A47K 3/122 108/134
3,451,360 A * 6/1969 Lemoyne ..... A47B 5/04 108/34
4,366,999 A * 1/1983 Koncelik ..... A47B 5/04 108/38
D302,772 S * 8/1989 Friedman ..... D25/138
5,480,058 A * 1/1996 Hutchins ..... A47B 5/04 206/549
5,653,178 A * 8/1997 Huczka ..... A47B 96/067 108/135
6,308,641 B1 * 10/2001 Kingbury ..... A47B 5/04 108/42
D544,275 S * 6/2007 Tanus ..... D6/555
(Continued)

FOREIGN PATENT DOCUMENTS

CN 202739181 U * 2/2013
FR 1287808 A * 3/1962 ..... A47B 5/04
JP 2011235843 A * 11/2011

*Primary Examiner* — Adriana Figueroa
*Assistant Examiner* — Jessie Fonseca
(74) *Attorney, Agent, or Firm* — Dunlap Bennett & Ludwig PLLC

(57) ABSTRACT

A fold down table mounted in a bathroom is provided. The fold down table includes a base panel and a fold down panel. The base panel includes an inner surface and an outer surface. The base panel is mounted to a wall within the bathroom adjacent to a toilet. The fold down panel includes an inner surface and an outer surface. A bottom portion of the fold down panel is secured to a bottom portion of the base panel by at least one hinge, such as two hinges. The fold down panel includes a closed position and an open position. The closed position includes the fold down panel pivoted towards the base panel and the open position includes the fold down panel pivoted away from the base panel so that the fold down panel is substantially perpendicular relative to the base panel.

9 Claims, 4 Drawing Sheets

(56) References Cited

U.S. PATENT DOCUMENTS

| | | | | |
|---|---|---|---|---|
| 7,690,159 | B1 * | 4/2010 | Arnold | A01K 1/0035 108/35 |
| 8,713,857 | B2 * | 5/2014 | Logue | A47B 46/005 160/200 |
| 2004/0261667 | A1 * | 12/2004 | Ma | A47B 5/04 108/42 |
| 2005/0057910 | A1 * | 3/2005 | Schnurr | A47B 46/005 361/797 |
| 2009/0241438 | A1 * | 10/2009 | Gallant | E04B 2/74 52/36.5 |
| 2013/0239486 | A1 * | 9/2013 | Bates | A47B 95/008 52/36.5 |

* cited by examiner

FOLD DOWN TABLE FOR BATHROOM

BACKGROUND OF THE INVENTION

The present invention relates to bathrooms and, more particularly, to a fold down table for a bathroom.

A bathroom is a room for personal hygiene activities, generally containing at minimum a toilet and sink. Commercial and residential bathrooms currently do not have an area to place personal belongings and electronics on to use while using the bathroom.

As can be seen, there is a need for a fold down table to place belongings on while using the bathroom.

SUMMARY OF THE INVENTION

In one aspect of the present invention, a fold down table mounted in a bathroom comprises: a base panel comprising an inner surface and an outer surface, wherein the base panel is mounted to a wall within the bathroom adjacent a toilet; a fold down panel comprising an inner surface and an outer surface, wherein a bottom portion of the fold down panel is secured to a bottom portion of the base panel by at least one hinge, wherein the fold down panel comprises a closed position and an open position, wherein the closed position comprises the fold down panel pivoted towards the base panel, and the open position comprises the fold down panel pivoted away from the base panel so that the fold down panel is substantially perpendicular relative to the base panel; and a connector releasably connecting the fold down panel to the base panel in the closed position.

In another aspect of the present invention, a method of providing a table in a bathroom comprises: mounting a base panel to a wall of the bathroom; securing a fold down panel to a bottom portion of the base panel by at least one hinge, wherein the fold down panel comprises a closed position and an open position, wherein the closed position comprises the fold down panel pivoted towards the base panel, and the open position comprises the fold down panel pivoted away from the base panel so that the fold down panel is substantially perpendicular relative to the base panel; and installing a connector operable to releasably connect the fold down panel to the base panel in the closed position, wherein the fold down panel is within arm's reach of a toilet in the open position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a fold down table/shelf for the bathroom stalls, urinals and confined spaces. A table that is in the stall, above the urinal or in the bathroom in general gives the bathroom user somewhere to place items brought with them to the bathroom. The fold down table of the present invention may include a table portion, two hinges securing the table portion to a base so that the fold down table portion folds smoothly and folds back flush, a handle to grab the table portion and pull down, and screws to mount to a wall, stall partition, drywall, tile or substrate to secure from movement or detachment from said substrate.

Figure 1:
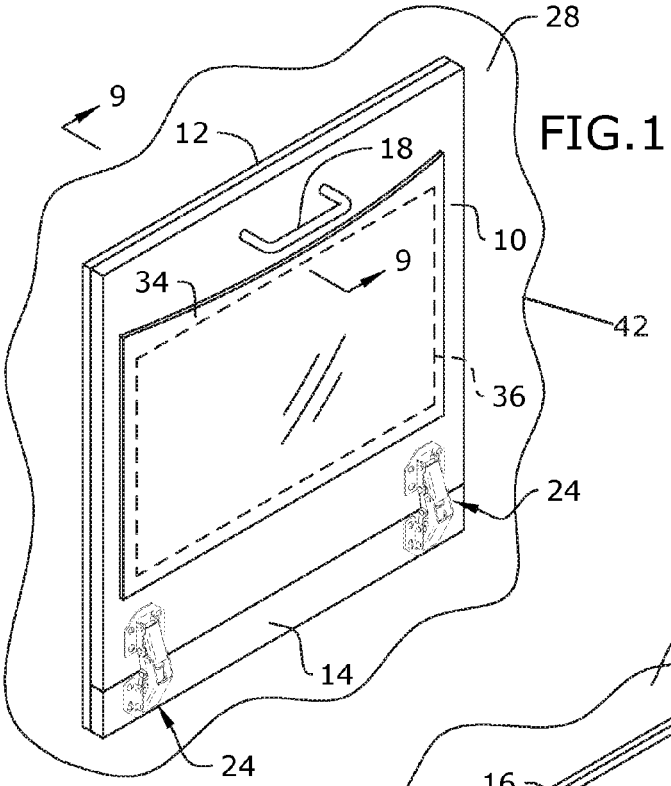
FIG. 1 is a top perspective view of an embodiment of the present invention shown in a closed position.
Figure 2:
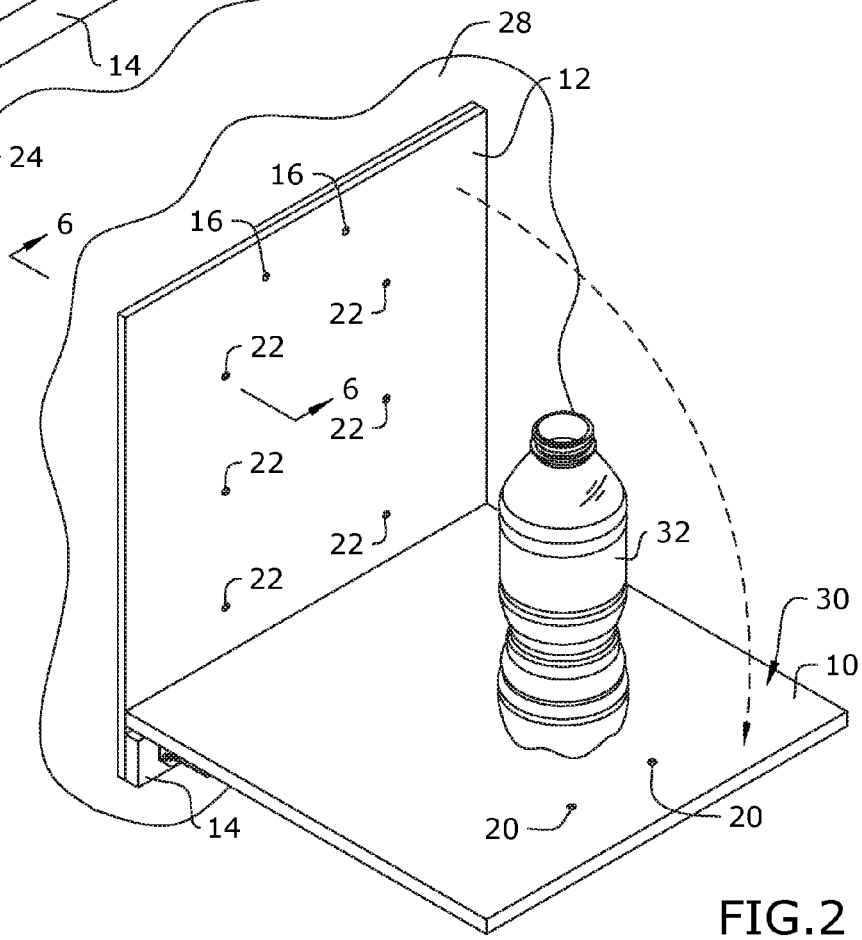
FIG. 2 is a top perspective view of an embodiment of the present invention shown in an open position.
Figure 3:
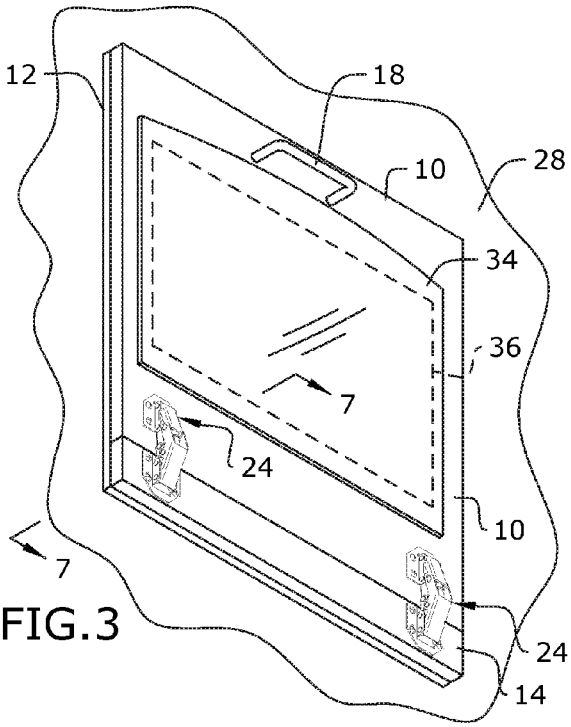
FIG. 3 is a bottom perspective view of an embodiment of the present invention shown in a closed position.
Figure 4:
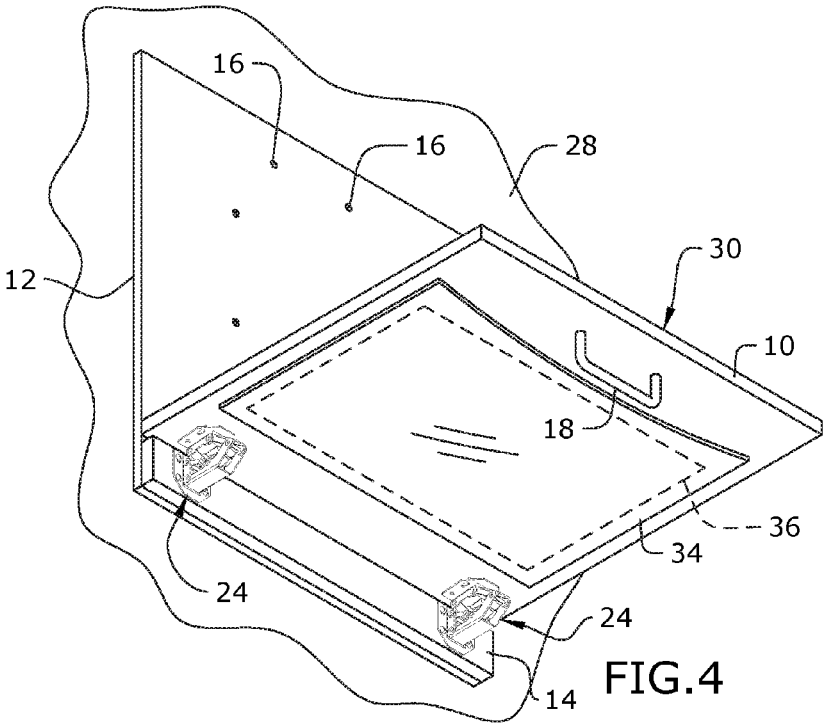
FIG. 4 is a bottom perspective view of an embodiment of the present invention shown in an open position.
Figure 5:
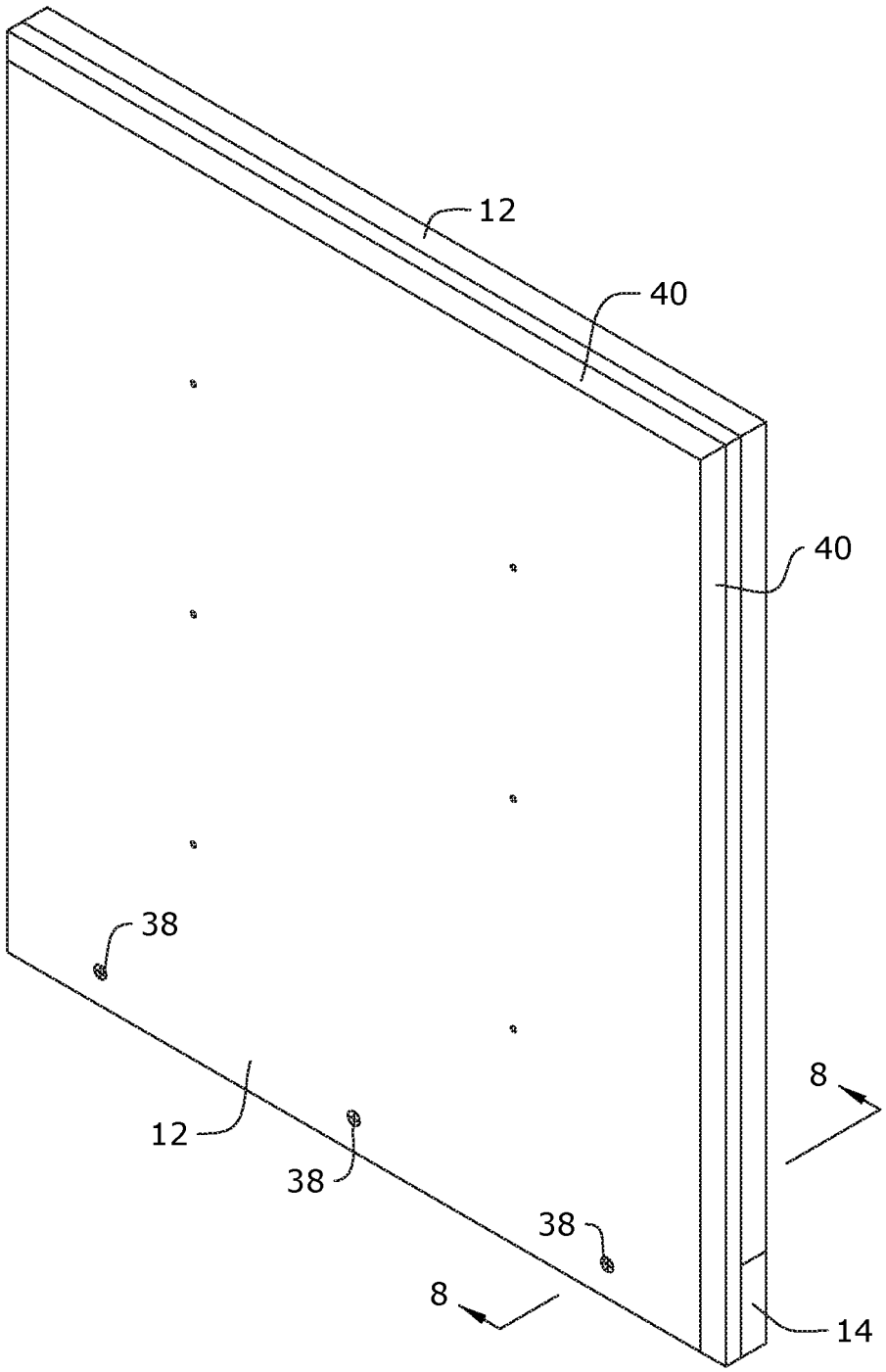
FIG. 5 is a rear perspective view of an embodiment of the present invention.
Figure 7:
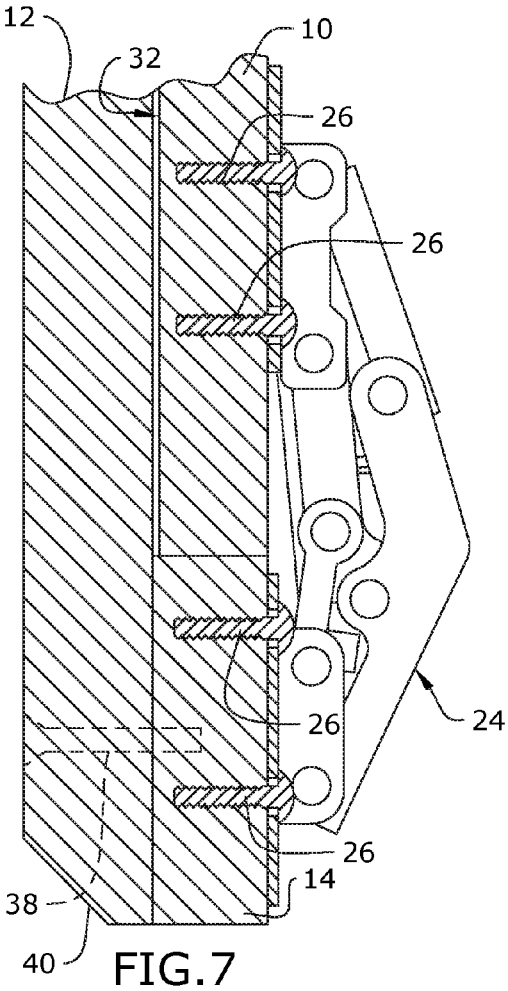
FIG. 7 is a section detail view of the present invention taken along line 7-7 in FIG. 3.
Figure 6:
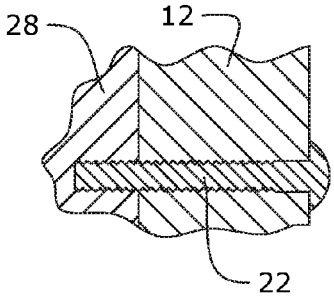
FIG. 6 is a section detail view of the present invention taken along line 6-6 in FIG. 2.
Figure 8:
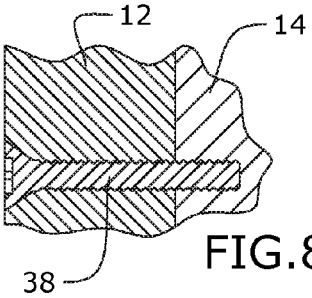
FIG. 8 is a section detail view of the present invention taken along line 8-8 in FIG. 5.
Figure 9:
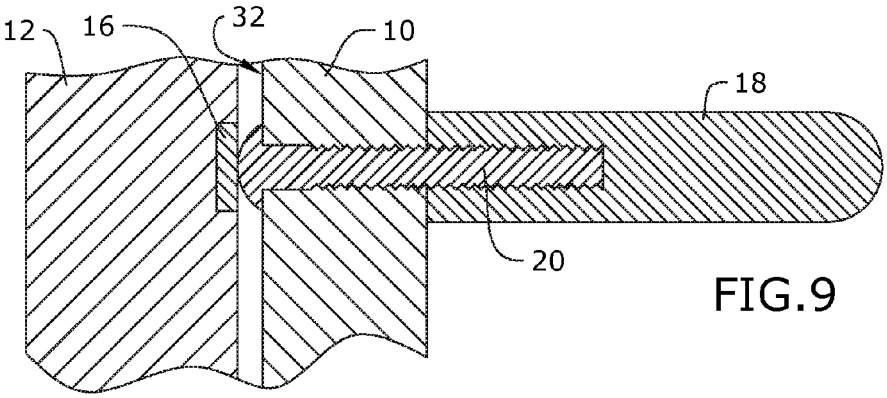
FIG. 9 is a section detail view of the present invention taken along line 9-9 in FIG. 1.

Referring to FIGS. 1 through 9, the present invention includes a fold down table mounted in a bathroom 42. The fold down table includes a base panel 12 and a fold down panel 10. The base panel 12 includes an inner surface having a beveled edge 40 and an outer surface. The base panel 12 is mounted to a wall 28 within the bathroom 42 adjacent to a toilet. The fold down panel 10 includes an inner surface 30 and an outer surface. A bottom portion of the fold down panel 10 is secured to a bottom portion of the base panel 12 by at least one hinge 24, such as two hinges 24. The fold down panel 12 includes a closed position and an open position. The closed position includes the fold down panel 10 pivoted towards the base panel 12 and the open position includes the fold down panel 10 pivoted away from the base panel 12 so that the fold down panel 10 is substantially perpendicular relative to the base panel 12. A connector releasably connects the fold down panel 10 to the base panel 12 in the closed position.

In certain embodiments, the present invention may include a hinge ledge 14. The hinge ledge 14 may include a rectangular strip protruding from a bottom portion of the outer surface of the base panel 12. In such embodiments, the hinges 24 may secure the fold down panel 10 directly to the hinge ledge 14. The hinge ledge 14 may be secured to the bottom portion of the base panel 12 by a plurality of hinge ledge screws 38. The hinge ledge 14 may support the fold down table 10 in the closed position, relieving stress from the hinges 24.

The outer surface of the fold down panel 10 may include accessories. For example, a handle 18 may be secured to the outer surface of the fold down panel 10, such as a U-shaped handle. A user may thereby grasp the handle 18 and pull away from the base panel 12, transitioning the fold down panel 10 from the closed position to the open position. The outer surface may further include a pocket 34 for storing documents 36. The pocket 34 may be formed of a transparent sheet having an outer edge. A portion of the outer edge is secured to the outer surface of the fold down panel 10, forming an opening leading into the pocket 34.

The connector may include a hook and loop fastener, clips, latches and the like. In certain embodiments, the connector may include a first magnetic material secured to the base panel 12 and a second magnetic material secured to the fold down panel 10. The first magnetic material is attracted to the second magnetic material. For example, the first magnetic material may include a magnet 16 and the second magnetic material include a handle bolt 20 securing the handle 18 to the outer surface of the fold down panel 10. The handle bolt 20 may include a ferromagnetic material that is attracted to the magnet 16. The handle bolt 20 aligns with the magnet 16 in the closed position, thereby keeping the fold down panel 10 in a closed position until an outside force is applied against the attraction of the magnets.

A method of providing a table in a bathroom 42 may include the following: mounting the base panel 12 to the wall 28 of the bathroom 42 using bolts 22; securing the fold down panel 10 to a bottom portion of the base panel 12 by at least one hinge 24 using bolts 26; and installing a connector operable to releasably connect the fold down panel 10 to the base panel 12 in the closed position, wherein the fold down panel 10 is within arm's reach of a toilet in the open position. To use the present invention, a user may pull on the handle 18 and pivot the fold down panel 10 away from the base panel 12, thereby transitioning the fold down panel 10 from the closed position to the open position. A user may then place an item 32 on the inner surface 30 of the fold down panel 10.

It should be understood, of course, that the foregoing relates to exemplary embodiments of the invention and that modifications may be made without departing from the spirit and scope of the invention as set forth in the following claims.

What is claimed is:

1. A fold down table mounted in a bathroom comprising:

a base panel comprising a top portion, a bottom portion, an inner surface, an outer surface, and a pair of magnets attached to the outer surface near the top portion, wherein the base panel is mounted to a wall within the bathroom;

a fold down panel comprising a top portion, a bottom portion, an inner surface and an outer surface, wherein the bottom portion of the fold down panel is secured to the bottom portion of the base panel by at least one hinge;

a U-shaped handle secured to the outer surface and near the top portion of the fold down panel by a pair of fasteners, wherein the fold down panel comprises a closed position and an open position, wherein the closed position comprises the fold down panel pivoted towards the base panel so that the inner surface of the fold down panel abuts against the outer surface of the base panel, wherein the pair of magnets attract the pair of fasteners and thereby releasably retain the fold down panel in the closed position, and the open position comprises the fold down panel pivoted away from the base panel so that the fold down panel is substantially perpendicular relative to the base panel.

2. The fold down table of claim 1, wherein the base panel further comprises a hinge ledge protruding from the bottom portion of the outer surface, wherein the fold down panel is secured to the hinge ledge by the at least one hinge.

3. The fold down table of claim 1, further comprising a pocket secured to the outer surface of the fold down panel.

4. The fold down table of claim 3, wherein the pocket is formed of a transparent sheet comprising an outer edge, wherein a portion of the outer edge is secured to the outer surface forming an opening leading into the pocket.

5. The fold down table of claim 1, wherein an edge of the inner surface of the base panel is beveled.

6. A method of providing a table in a bathroom comprising:

mounting a base panel to a wall of the bathroom, wherein the base panel comprises a top portion, a bottom portion, an inner surface, an outer surface, and a pair of magnets attached to the outer surface near the top portion;

securing a fold down panel to the bottom portion of the base panel by at least one hinge, wherein the fold down panel comprises a top portion, a bottom portion, an inner surface, an outer surface and a U-shaped handle secured to the outer surface and near the top portion by a pair of fasteners, wherein the table comprises a closed position and an open position, wherein the closed position comprises the fold down panel pivoted towards the base panel so that the inner surface of the fold down panel abuts against the outer surface of the base panel, wherein the pair of magnets attract the pair of fasteners and thereby releasably retain the fold down panel in the closed position, and the open position comprises the fold down panel pivoted away from the base panel so that the fold down panel is substantially perpendicular relative to the base panel.

7. The method of claim 6, wherein the base panel further comprises a hinge ledge protruding from the bottom portion of the outer surface, wherein the fold down panel is secured to the hinge ledge by the at least one hinge.

8. The method of claim 6, wherein the fold down panel further comprises a pocket secured to an outer surface of the fold down panel.

9. The method of claim 6, wherein an edge of the inner surface of the base panel is beveled.

* * * * *